United States Patent [19]

Hancy

[11] Patent Number: 5,027,703

[45] Date of Patent: Jul. 2, 1991

[54] PROFILE SQUEEGEE BLADE FOR SCREEN PROCESS PRINTING

[76] Inventor: Raymond E. Hancy, 1475 Green Acres Rd., #105, Eugene, Oreg. 97401

[21] Appl. No.: 529,624

[22] Filed: May 29, 1990

[51] Int. Cl.[5] ..... B41F 15/44

[52] U.S. Cl. ..... 101/123; 15/256.5

[58] Field of Search ..... 101/123, 124, 127, 157, 101/169; 15/256.5, 256.51, 256.53

[56] References Cited

U.S. PATENT DOCUMENTS

| | | | |
|---|---|---|---|
| 3,110,919 | 11/1963 | Barnby | 101/123 |
| 3,624,860 | 12/1971 | Grimston et al. | 15/256.51 |
| 4,964,336 | 10/1990 | Bock et al. | 101/157 |

FOREIGN PATENT DOCUMENTS

| | | | |
|---|---|---|---|
| 0121060 | 9/1980 | Japan | 101/169 |
| 0292435 | 12/1987 | Japan | 101/123 |

*Primary Examiner*—Edgar S. Burr
*Assistant Examiner*—Ren Yan
*Attorney, Agent, or Firm*—John F. Ingman

[57] ABSTRACT

A profile squeegee blade is formed by forming the forward portion of a squeegee blade to create a leading cavity which extends the entire length of the squeegee blade, to define and control the shape and volume of leading ink. The ends of the profile squeegee cavity are sealed to preclude side run-off of the ink. Cavity end seals may be permanent or made as removable inserts to facilitate cleaning and manufacture. Additional control of the ink supply may be obtained through a series of weeper vent holes formed and extending between the internal cavity and the forward face of the squeegee blade, allowing the operator to maintain or release ink pressure by the blocking or unblocking of the holes. A preferred profile design extends vertically in front of the leading edge of the forwardly tilted squeegee blade, and includes a downwardly extending lip at its leading edge so as to provide forward enclosure for the cavity. Alternative to the internal profile cavity, an external cavity may be formed through the positioning of an appropriately cavity-shaped, resilient, external profile member attached to the front of the squeegee handle and contacting the squeegee blade along its length. The ends are sealed to maintain a constant volume of ink along the length of the squeegee blade. A groove may be formed along the length of the squeegee blade to permit sub-surface seating of the contacting end of the external profile member.

10 Claims, 2 Drawing Sheets

PROFILE SQUEEGEE BLADE FOR SCREEN PROCESS PRINTING

BACKGROUND OF THE INVENTION

1. Field of the Invention

This invention involves a squeegee blade as used in screen process printing, and, more particularly, a squeegee blade having an ink-holding cavity profile with the cavity located immediately in front of the contact edge of the squeegee blade.

2. Description of the Prior Art

For the past one hundred years, the squeegee used for screen process printing (also known as silk screen printing) has utilized a flat rectangular blade with a sharp contact edge. Some progress has been made in providing squeegee blades made of sophisticated plastics and synthetic rubber having varying hardnesses, the desirability of their use depending on the particular ink used or substrate printed. The squeegee blade, when placed in a holder, has continued to be the accepted tool to move ink across a screen fabric and stencil surface to produce print impressions.

The squeegee characteristically is drawn at a forward angle across the surface of the screen fabric. The forward movement of the tilted conventional squeegee blade across the surface of the screen fabric moves the ink directly ahead of its contact edge. As stencil openings are contacted through the screen fabric, ink is deposited upon the substrate. Should few or no openings in the stencil be present, the ink eventually would be dispersed out past the ends of the squeegee blade, that being the avenue of lesser resistance as the squeegee blade moves forward There are significant shortcomings in the conventional squeegee blade operation, including lack of control of the ink supply, wear of the screen fabric, operator fatigue, and lack of efficiency.

The objectives of the present profile squeegee blade invention are:

1. Better print quality by improved control of ink supply and feed to the substrate;
2. Reduction in screen fabric wear;
3. Reduction in squeegee effort, particularly reduction in fatigue on long hand runs and large surfaces;
4. Action of the squeegee blade as a scraper rather than a tool for forcing ink through the screen fabric, thereby reducing squeegee wear;
5. Reduction in downtime due to screen fabric clogging caused by varying squeegee blade pressure;
6. Variability of profile design to accomodate various inks and substrates; and
7. Application to both hand and machine operations.

SUMMARY OF THE INVENTION

The present invention provides a profile squeegee blade to meet the aforementioned objectives. A profile squeegee blade is formed by modifying, as by cutting or extrusion, the forward portion of a squeegee blade to create a leading cavity which extends the entire length of the squeegee blade. The cavity may take a variety of shapes and forms, as desired, to define and control the shape and volume of leading ink, and thereby control the ink pressure exerted on the screen fabric and stencil as the squeegee blade is drawn across it. Importantly, the ends of the profile squeegee cavity are sealed to preclude side run-off of the ink, thus creating uniform ink pressure along the entire length of the cavity, End seals may be permanent or made as removable inserts to facilitate cleaning and manufacture.

Additional hydrodynamic control of the ink supply may be obtained through a series of weeper vent holes formed and extending between the internal cavity and the forward face of the squeegee blade. The presence of the vent holes allows the operator to maintain or release ink pressure by the blocking or unblocking of the holes, thereby supplementally controlling the release of ink from the cavity during use.

A preferred profile design, providing generally acceptable pressure and control, includes a smoothly rounded cavity extending vertically in front of the leading edge of the forwardly tilted squeegee blade, the leading edge having been moved rearwards from its conventional position. The preferred cavity includes a downwardly extending lip at its leading edge so as to provide forward enclosure for the cavity as well as being enclosed at the rear and sides.

The profile squeegee blade may include an internal profile, as described above, or alternatively may present an external cavity through the positioning of an appropriately cavity-shaped, spring-biased, external profile member attached to the front of the squeegee handle and contacting the squeegee blade along its length. The spring tension assures continuing contact of an edge of the external profile member against the squeegee blade during use, overcoming flexing in the blade and maintaining the desired profile cavity. As with the internal profile, the ends are sealed to maintain constant volume of ink along the length of the squeegee blade. A groove may be formed along the length of the squeegee blade to permit sub-surface seating of the contacting end of the external profile member.

DESCRIPTION OF THE PREFERRED EMBODIMENT

Figure 1:
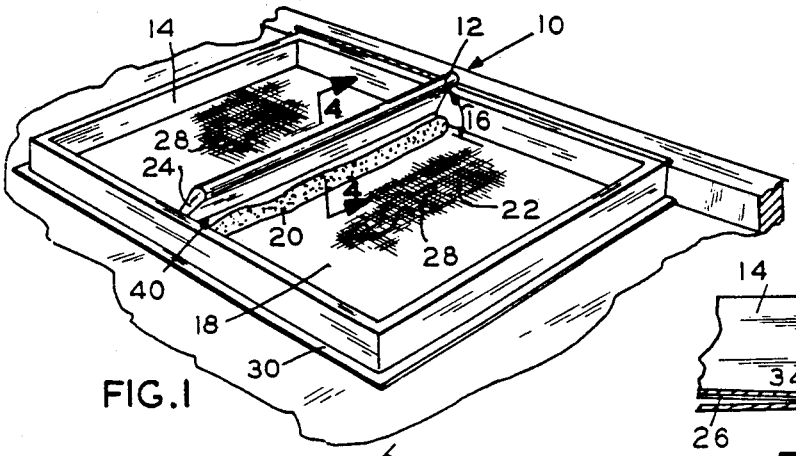
FIG. 1 illustrates a squeegee as used in manual screen process printing.
Figure 2:
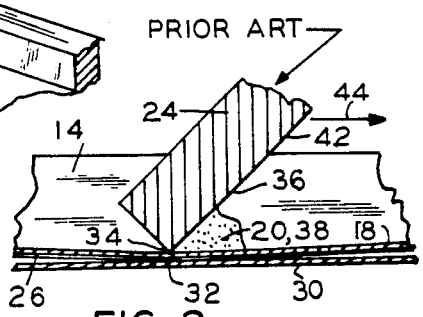
FIG. 2 illustrates an end view of a prior art squeegee blade, in use.
Figure 4:
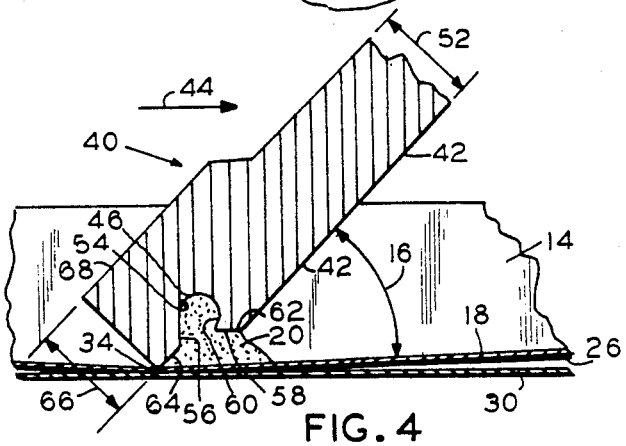
FIG. 4 illustrates an enlarged, cross sectional end view of the preferred internal profile squeegee blade, in use.

Turning now to the drawings, there is shown in FIG. 1 a squeegee 10 in manual use in screen process printing The squeegee handle 12 is grasped by the user and drawn within the frame 14 at an angle 16, normally 42- to 48-degrees from the horizontal, across the screen fabric 18. Ink 20, having been previously deposited the screen fabric 18, is wiped along and forced through the mesh 22 of the screen fabric 18 by the squeegee blade 24. Attached to and beneath the screen fabrIc 18 Is the stencil 26; open places or gaps 28 in the stencil 26 allow the ink 18 to penetrate and be deposited on the substrate 30, that is, the surface being printed. As illustrated in FIGS. 2 and 4, usually there will be some give or stretch to the screen fabric 18, therefore forming a shallow 'V' so that the screen fabric 18 and stencil 26 contact the substrate 30 at the location of contact 32 of the contacting edge 34 of the squeegee blade 24. With the conventional squeegee 10, as shown in FIG. 2, the ink 20 is forced through the screen fabric 18 primarily by the pressure of the contacting edge 34 and the forward surface 36 of the blade 24 immediately preceding the contacting edge 34, the ink being provided in an irregular pool 38 which proceeds and is pushed along at various depths and widths by the contacting edge 34.

Figure 3:
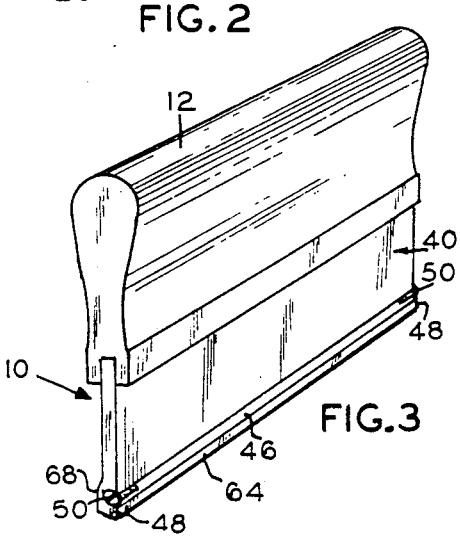
FIG. 3 illustrates a perspective view of a squeegee utilizing the preferred internal profile squeegee blade.

FIG. 3 illustrates a squeegee 10 having a profile squeegee blade 40. The profile squeegee blade 40 is formed by modifying the forward 42 portion, defined by the direction of movement 44 of the squeegee 10 in use, of a squeegee blade 24 to create a leading cavity 46 along its length. The cavity 46 provides a controlled, uniform volume and pressure of ink along its length and immediately preceding the contacting edge 34 of the blade 40. The cavity 46 may take a variety of cross-sectional shapes and forms, as desired, to define and control the shape and volume of leading ink 20, and thereby control the ink 20 1 pressure exerted on the screen fabric 18 and stencil 26 as the profile squeegee blade 40 is drawn across it.

The ends 48 of the cavity 46 are sealed to preclude side run-of of the ink 20, thereby creating the desired uniform volume of ink 20 along the entire length of the cavity 46. End 48 sealing may be permanent, or be removable inserts, as the plugs 50 illustrated in FIGS. 5 and 6, to facilitate cleaning and manufacture.

Figure 5:
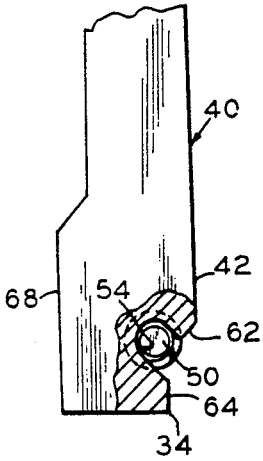
FIG. 5 illustrates an end view of the preferred internal profile blade, showing plug means of sealing the cavity ends.
Figure 6:
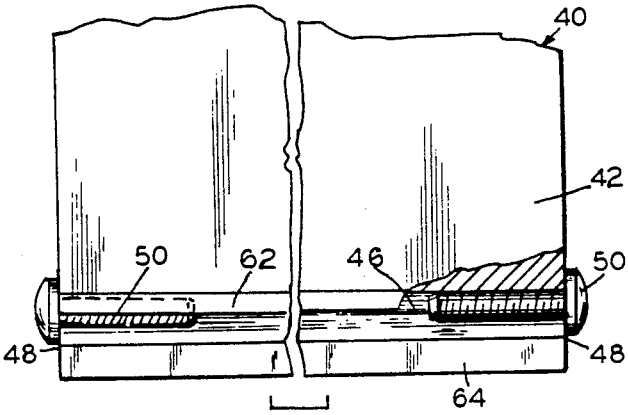
FIG. 6 illustrates a front view of an internal profile squeegee blade, showing plug means of sealing the cavity ends.

A preferred profile squeegee blade 40 design is shown at FIG. 4. Formed by extrusion, the preferred blade 40 provides a longitudinal cavity 46 along its length, having a cross-section as illustrated. With a profile squeegee blade 40 having a conventional thickness 52 of ⅜-inch, the circular upper portion 54 of the cavity 46 has a radius of 5/64-inch and extends tangentially from a vertical rear wall 56 approximately 225-degrees forward to the end of a downward extending lip 58 at the forward end 60 of the cavity 46. The lip 58 itself has a horizontal lower edge 62 which lays approximately ⅛-inch above the screen fabric 18 in use. Forward of the contacting edge 34, an ⅛-inch wide face 64, angled at approximately 45-degrees in use, is present when the profile squeegee blade 40 is new. Subsequent sharpening of the contacting edge 34 may reduce the height of the face 64 and thus the height of the lower edge 62 of the lip 58 above the screen fabric 18. In the preferred profile squeegee blade 40, the ends 48 may be sealed with a 3/16-inch diameter plug 50 fitting within the circular portion 54 of the cavity 46 as illustrated in FIG. 5 and FIG. 6.

In the preferred profile squeegee blade 40, due to the location of the cavity 46 along the leading face 36, the contacting edge 34 has been moved rearward approximately ⅛-inch. Adjustment in the lower end thickness 66 of the profile squeegee blade 40 to return to the original and upper thickness 52 of ⅜-inch is provided by adding ⅛-inch to the rear 68 of the bladė 40, thereby retaining to a considerable extent the feel and flexibility of a conventional rectangular blade, 24, seen in FIG. 2.

With the movement in the forward direction 44 by the squeegee, ink 20 will accumulate within the cavity 46, which is enclosed to the front 60, rear 56, and sides 48, so as to completely fill the cavity 46, providing a uniform volume of ink 20 immediately in front of the contacting edge 34 along the entire length of the profile squeegee blade 40. The uniform volume of ink 20, thus located, will present a uniform downward ink 20 pressure, forcing the ink 20 through the mesh 22 of the screen fabric 18 and gaps 28 of the stencil 26 where they occur. The penetration of the ink 20, thus uniformly pressured, does not require reliance on uniform pressure being applied by the user on the contacting edge 34 of the squeegee blade 40 in order to achieve high quality screen process printing. Required hand pressure is decreased, the contacting edge 34 now simply wiping surplus ink 20 to the front rather than the edge 34 itself supplying the application force.

Figure 7:
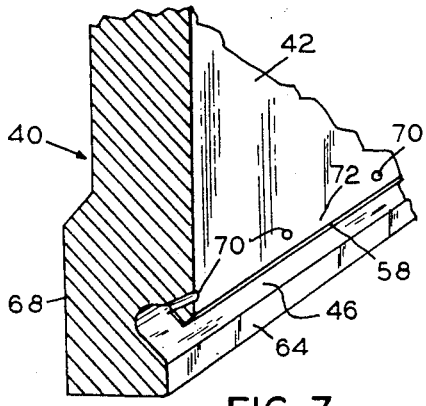
FIG. 7 illustrates a sectional perspective view of an internal profile squeegee blade having weeper vent holes.
Figure 8:
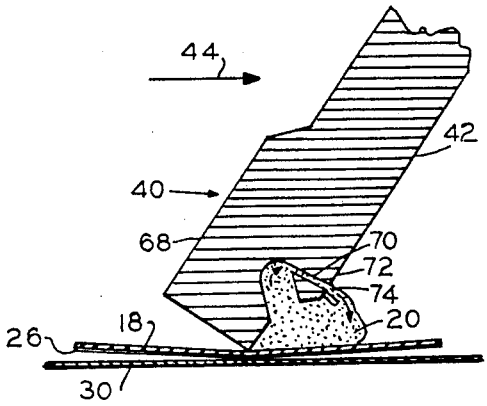
FIG. 8 illustrates a sectional side view of the internal profile squeegee blade with weeper vent holes, in use.

If less ink 20 pressure is required than that provided by the cavity 46 volume and forward movement 44 of the profile squeegee blade 40, such excessive pressure may be relieved by the use of a plurality of weeper vent holes 70 extending between the cavity 46 and the front face 72 of the profile squeegee blade 40, as seen in FIGS. 7 and 8. These holes 70 allow the ink 20 to be released from the cavity 46, thereby decreasing the pressure within the cavity 46. The vented ink 74 falls from the blade front face 72 to join the ink 20 supply in front of the blade 40, and to subsequently reenter the cavity 46. Such vent holes 70 may be selectively plugged or unplugged, as desired by the user to provide the pressure pattern desired. A linear series of 1/16-inch diameter holes 70 per linear inch of the cavity 46 works well.

Figure 9:
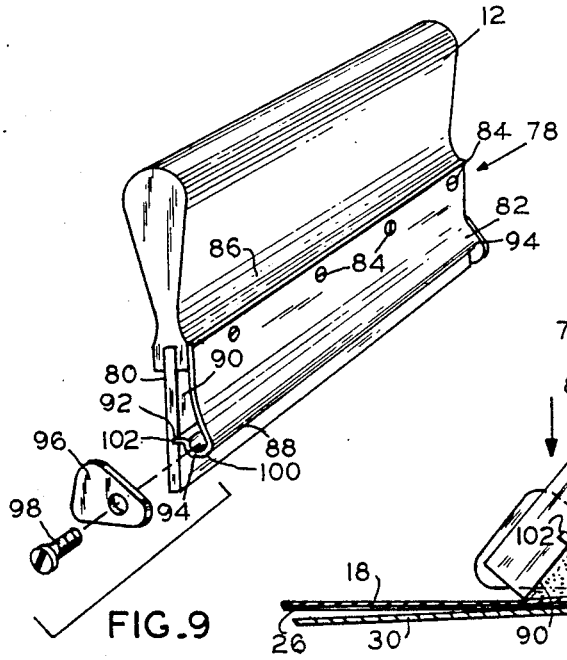
FIG. 9 illustrates a perspective view of a squeegee having an external profile squeegee blade.
Figure 10:
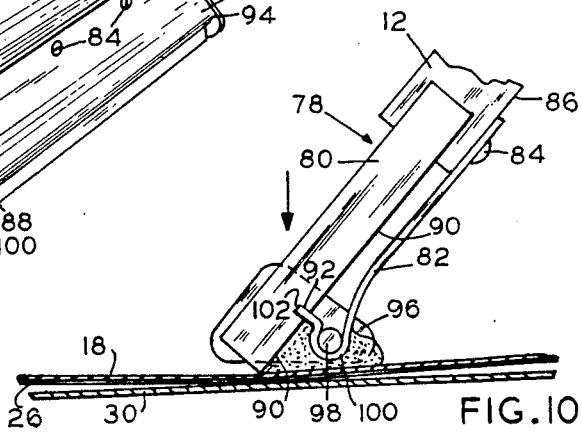
FIG. 10 illustrates a side view of the external profile squeegee blade.

Alternative to the above described profile squeegee blade 40, which provides an internal cavity 46, is a profile squeegee 78 with external profile squeegee blade 80, as best seen in FIGS. 9 and 10. An external profile member 82, attached with screws 84 or the like to the forward side 86 of the squeegee handle 12, is formed to extend downwardly, along the entire length of the squeegee blade 80, so as to form a profile cavity 88, in combination with the forward face 90 of the blade 80, similar in shape to the preferred internal cavity 46. The external profile member 82 is formed of a resilient material, such as spring steel, to allow its lower edge 92 to remain in contact with the forward face 90 of the squeegee blade 80, so as to keep the cavity 88 intact and preclude upward leakage therefrom while the squeegee blade 80 flexes in normal use.

As with the internal profile squeegee blade 40, the ends 94 are sealed to maintain a constant volume of ink 20 along the length of the squeegee blade 80. Removable end sealing may be obtained by an end plate 96 attached at the ends 94 of the external profile member 82 using a fastening member 98, such a a plug or screw, fitting within the curvature 100 of the external profile member 82. A groove 102 may be formed along the length of the squeegee blade 80 to permit subsurface seating of the lower edge 92 of the external profile member 82 against the forward face 90 of the squeegee blade 80, as illustrated, thereby enhancing the seal between the external profile member 82 and the blade 80 itself.

While the above description is oriented toward hand-operated squeegees 10, the profile squeegee blade, 40 or 80, also may be used in mechanical or machine screen process printing operations.

It is thought that the profile squeegee blade for screen process printing of the present invention and its many attendant advantages will be understood from the foregoing description and that it will be apparent that various changes may be made in form, construction and arrangement of the parts thereof without departing from the spirit and scope of the invention or sacrificing all of its material advantages, the forms hereinbefore stated being merely exemplary embodiments thereof.

I claim:

1. A profile squeegee blade, comprising;

a. a squeegee blade, having a longitudinal contact edge and a front side corresponding to the direction of motion of said blade;

b. a longitudinal cavity formed in the front side of said squeegee blade and proximate to the contact edge;

c. means for sealing said longitudinal cavity at its ends;

d. said cavity formed to provide an open-bottom, vertically extending reservoir for ink located immediately preceding the contact edge of the squeegee blade.

2. The profile squeegee blade, as recited in claim 1, wherein the means for sealing the ends are removable.

3. The profile squeegee blade, as recited in claim 1, wherein the longitudinal cavity extends substantially the full length of the squeegee blade.

4. The profile squeegee blade, as recited in claim 1, wherein, additionally, there are a plurality of vent holes formed between and interconnecting the longitudinal cavity and the front side of the squeegee blade.

5. The profile squeegee blade, as recited in claim 1; wherein the longitudinal cavity includes a downwardly extending lip at the front side of the squeegee blade so as to provide frontal closure for the cavity.

6. The profile squeegee blade, as recited in claim 1, wherein the squeegee blade, having an upper thickness extending above the longitudinal cavity, is formed to have a lower thickness, proximate to said contact edge, substantially equal to said upper thickness.

7. The profile squeegee, as recited in claim 1, wherein the cross section of the profile squeegee blade is formed to be shaped substantially as shown in FIG. 4.

8. A profile squeegee, comprising:

a. a squeegee blade, having a longitudinal contact edge and a front face;

b. means for holding the squeegee blade;

c. an external profile member, having a first edge and a second edge, said external profile member being attached at its first edge to the means for holding the squeegee blade, and extending downwards to said second edge, said second edge contacting the squeegee blade along the entire length of the front face thereof;

d. said external profile member being formed to provide an external, open-bottom, vertically-extending, longitudinal cavity proximate to and preceding the contact edge of the squeegee blade;

e. means for sealing said longitudinal cavity at its ends.

9. The profile squeegee, as recited in claim 8, wherein the external profile member is formed of resilient material, thereby maintaining contact of the second edge with the squeegee blade during flexing motions resulting from use.

10. The profile squeegee, as recited in claim 8, wherein, additionally, the squeegee blade is formed with a longitudinal groove, formed and positioned on its front face, so that the second edge engages said groove, providing enhanced protection against ink penetration past the contact between the external profile member and the squeegee blade.

* * * * *